United States Patent [19]

Bodet

[11] 3,972,179

[45] Aug. 3, 1976

[54] CHANGEABLE DISPLAY DEVICE

[76] Inventor: Pierre Bodet, 49340 Trementines, France

[22] Filed: Mar. 28, 1975

[21] Appl. No.: 562,839

[30] Foreign Application Priority Data

Mar. 28, 1974 France ..... 74.10730

[52] U.S. Cl. ..... 58/85.5; 58/125 R

[51] Int. Cl.² ..... G04B 27/08

[58] Field of Search ..... 58/125 C, 126 E, 125 R, 58/85.5, 6 R, 4 R, 4 A, 6 A; 235/133 R, 133 A, 134, 137, 138, 140, 143, 91 R, 91 PR, 91 A

[56] References Cited

UNITED STATES PATENTS

| | | | |
|---|---|---|---|
| 543,235 | 7/1895 | Fowler | 58/6 R |
| 905,956 | 12/1908 | Thrasher | 58/125 C |
| 2,762,190 | 9/1956 | Holzner | 58/125 C X |
| 2,959,914 | 11/1960 | Harada | 58/125 C |
| 3,279,166 | 10/1966 | Funaki | 235/133 R X |
| 3,721,086 | 3/1973 | Flumm | 235/91 R X |

*Primary Examiner*—Ulysses Weldon
*Attorney, Agent, or Firm*—Young & Thompson

[57] ABSTRACT

Automatic indicia changer, such as a clock-calendar for displaying months, days of the month, days of the week, hours and minutes, comprises a plurality of series of plates bearing the various indicia, each series being rotatable about its axis under the influence of a ratchet wheel that is moved stepwise by a dog, each step changing the indicia one increment. The dog is swung by a lever which in turn is swung by a rotary cam. The first series of indicia is driven by a motor; while the first series drives the second and the second drives the third, and so on. Thanks to the ratchet wheel and pawl drive, each series of indicia can be manually adjusted without interrupting the automatic drive. Manual adjustment may be effected either rapidly, by turning the ratchet wheel with an external knob, or stepwise by pressing with the finger on a protrusion on the associated swingable lever.

5 Claims, 7 Drawing Figures

FIG.2
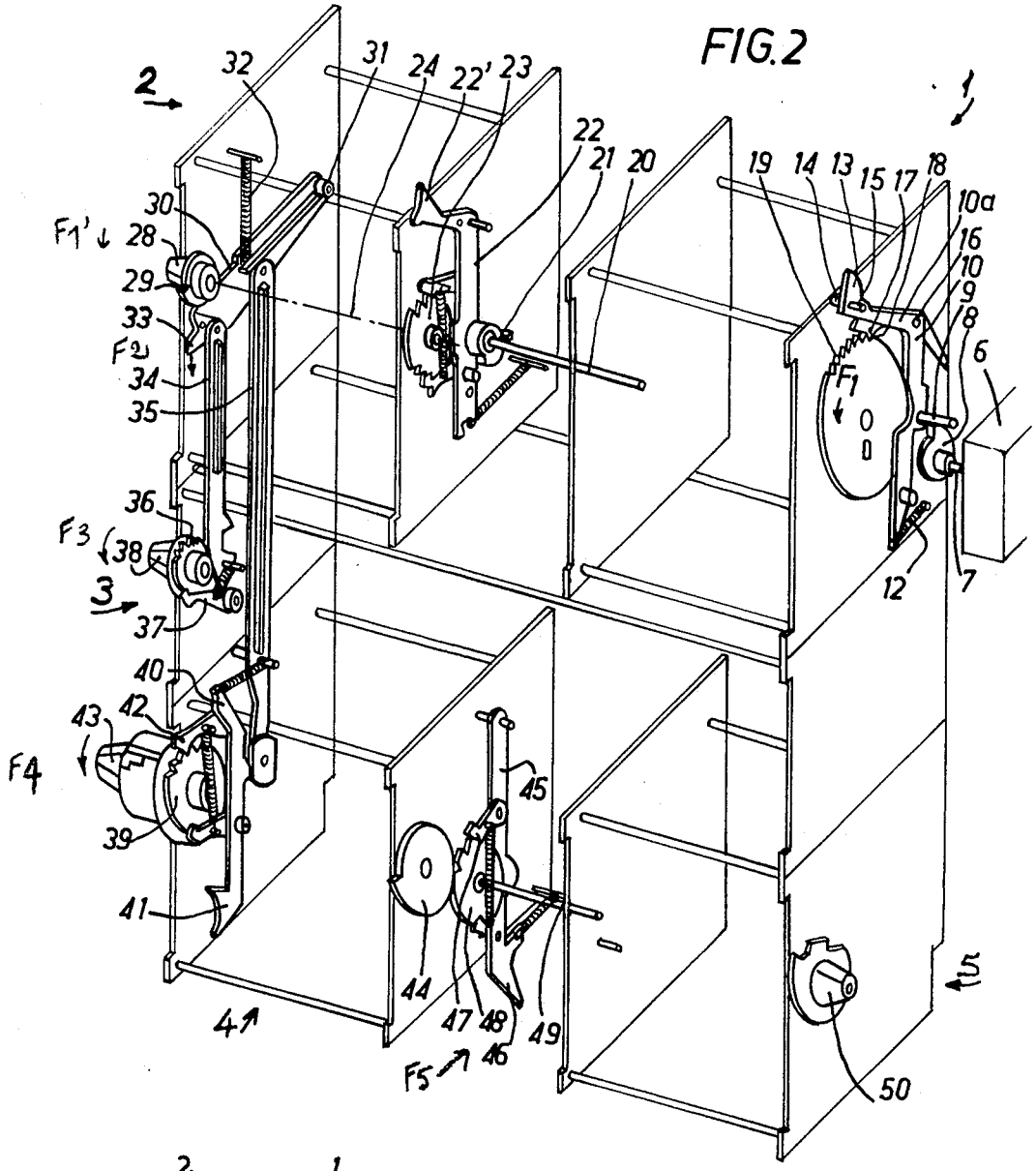
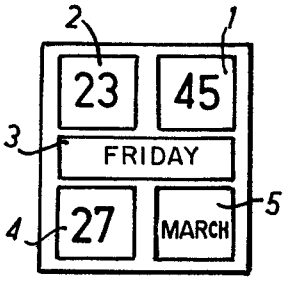
FIG.1

CHANGEABLE DISPLAY DEVICE

The present invention relates to a changeable display device, more particularly of the type for displaying the date or the time or both, in an automatic manner.

In changeable display devices, there are two basic components: the display portion, and the motor means for operating the display portion. The display portion itself can comprise either a dial or the like on which one or two hands are movably mounted, the position of the hand or hands indicating the desired information. This mode of display is particularly useful for indicating time, with two hands, or for indicating weight.

Another display mode is by direct display, for example by means of members bearing letters or numbers that appear successively in a window. The characters are borne by a series of plaques which successively occupy the window, this mode of display being particularly useful in train stations or airports to announce the arrival and departure of trains and aircraft.

The drive means for the known display devices are of all types, from the simplest to the most complex, such as synchronous motors for time displays, impulse receivers for electronic control, and so on.

Known apparatus for performing these functions suffers from the difficulty that it is complicated and expensive and difficult if not impossible of repair or adjustment by any person other than a skilled specialist.

Accordingly, it is an object of the present invention to overcome these difficulties and disadvantages, by providing a changeable display device that will be relatively simple and inexpensive to manufacture, easy to install, operate, adjust, maintain and repair, and rugged and durable in use.

Briefly stated, the present invention achieves these objects by the provision of a changeable display device which is preferably but not exclusively useful for displaying date and time, comprising a casing whose forward face is provided with windows at appropriate positions, the interior of the casing containing a chassis which supports motor means and a series of plates marked with indicia that can be selectively successively presented in the appropriate windows, each series of plates being rotatively driven by mechanical means controlled by the preceding series of plates or by a motor in the case of the first series, the display device being characterized in that each of the means for driving a series of plates may be manually controlled without interrupting the automatic drive.

The invention thus being concerned with the means for driving in rotation the various series of display plates, the other features and/or characteristics of the display device which are known in and of themselves will not be described in great detail in the disclosure that follows.

The drive means of the present invention are characterized in that each series of plates is driven by a ratchet wheel, the ratchet wheel being driven stepwise by a tooth or pawl on a lever whose movement is controlled by rotation of a cam secured to the drive axle of the preceding series of plates or of the motor in the case of the first series.

Of course, ratchet wheel drive is known per se, but the provision of a series of these drives in cascade, one for each series of plates, is novel and has the advantage of permitting at the same time the achievement of two operations previously thought to be mutually exclusive:

1. Direct drive by a motor secured in the casing; and
2. Manual control by means of setting knobs or levers.

Preferably, the casing is designed for easy opening, thereby rendering the mechanism as well as the knobs and levers easily accessible.

The levers are arranged for stepwise advancement of the ratchet wheel and they may consist simply of a projecting portion provided at an accessible end of each lever so as to permit manual swinging of the lever against a spring, the displacement of a pawl advancing the wheel an increment of one notch for each oscillation of the lever.

The knobs are secured to the outer ends of the axles carrying the series of plates, such that their rotation in the intended directions drives in rotation the plates. Thus each series of plates may have one or two manual drive means in addition to the automatic drive.

These and other objects, features and advantages of the present invention will become apparent from a consideration of the following description, taken in connection with the accompanying drawings, in which:

FIG. 1 is an elevational view of the face of a clock calendar according to the present invention;

FIG. 2 is a somewhat schematic perspective view of the mechanism of the present invention with the casing removed;

Figure 3:
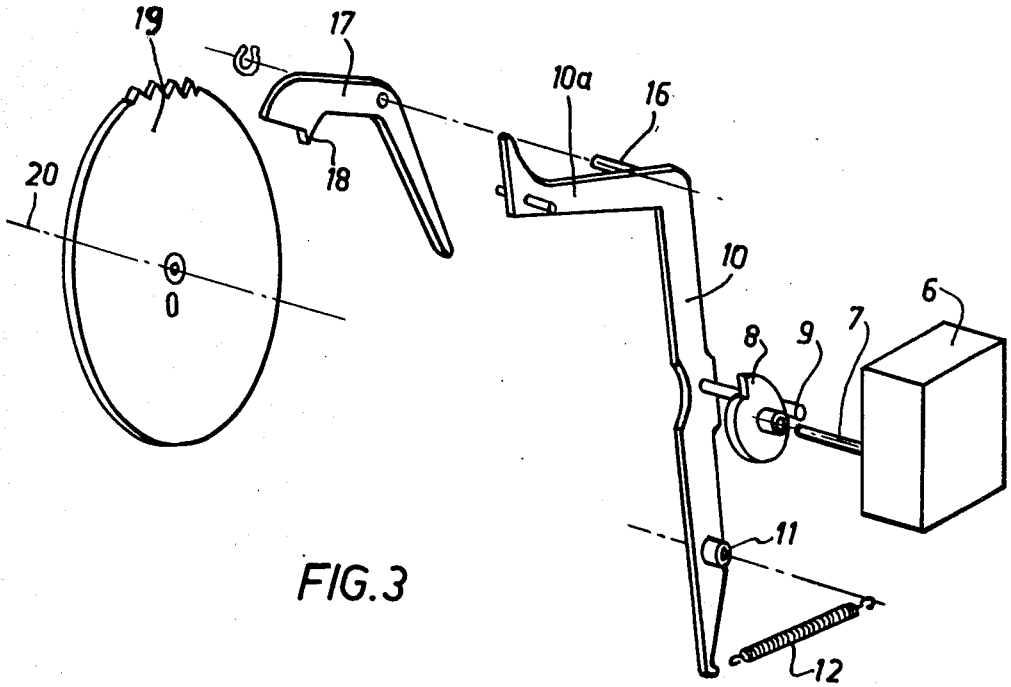
FIG. 3 is an exploded perspective view of one portion of the drive means according to the present invention.

Referring now to the drawings in greater detail, and first to FIG. 1, there will be seen a calendar clock face according to the present invention comprised by a casing having five windows through which may be read the month, day of the month, day of the week, hour and minutes. These five data are carried by five series of plates arranged in a generally circular series for rotation about horizontal axes.

FIG. 2 shows the drive means for these series of plates, the casing having been removed so as better to illustrate the structure. As best seen in FIG. 2, the chassis is so arranged as to provide five blocks or modules each comprised by two parallel walls spaced apart by interconnecting rods. The pairs of walls carry axles and other mechanical elements; and the pairs of walls are interconnected to each other by the chassis in known ways. There are thus provided five modules comprising module 1, to show the minutes; module 2, to show the 24 hours of the day; module 3 to show the name of the day of the week; module 4 to show the day of the month; and module 5 to show the name of the month.

Module 1 is driven by a motor indicated generally at 6, the drive shaft 7 of the motor driving in rotation a cam 8 that bears on the pin 9 of a lever 10 that pivots on the chassis about axis 11 (see FIG. 3) against the action of a coil tension spring 12 which is secured at its other end to the adjacent wall of the module 1. Lever 10 has an elbowed upper part **10*a* that extends substantially at a right angle to the lower part of lever 10 and that terminates in an upwardly extending upper end 13 below the upper end of which are mounted pins 14 and 15 which together define a crosspiece to maintain lever 10 properly spaced between the module wall and the casing (not shown). At about the bend of the elbow, a pin 16 is carried by the lever 10 about which an element 17 pivots that bears a tooth or pawl 18**.

The ratchet wheel 19 is mounted for rotation about the horizontal axle 20 on the associated wall of module 1. Axle 20 extends horizontally through module 1 and on the side of module 1 opposite ratchet wheel 19 carries a cam 21 which may be identical to cam 8.

Figure 5:
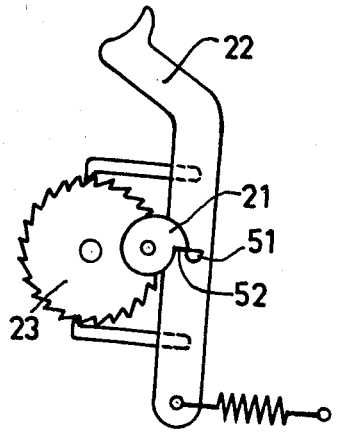
FIG. 5 shows a detail of the drive mechanism.

A comparison of FIGS. 2 and 5 shows that cam 21 has a step 52 that frees a detent 51 on a lever 22 when the minute module 1 reaches "59" and changes to "00".

Figure 6:
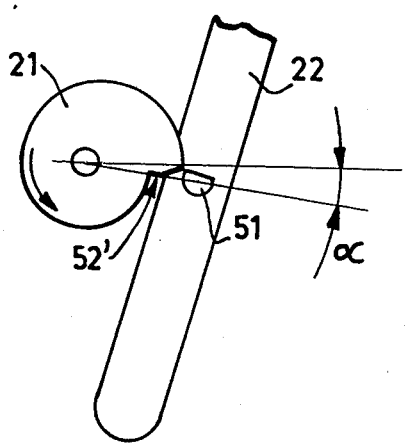
FIG. 6 shows the profile of a drive cam and its associated mechanism.

FIG. 6 shows in greater detail a preferred form of the step 52 of cam 21, the step 52 being divided into two portions separated by a shoulder 52', the outer portion subtending an angle $\alpha$ through which the lever movement is retarded as detent 51 falls past the step. The angle $\alpha$ is very small and corresponds to the play or slack between the clock drive 6 and the axle 20.

Cam 21 is set with a very small advance so that the angle $\alpha$ sweeps past the pin 51 at the moment when the minute inscription 59 is about to change. At this moment the pin 51 engages the inclined ramp of step 52 and presses against cam 21 to drive the axles 20 and 24 thereby simultaneously to shift module 2 (the hours) by one increment and to switch the plate 59 of module 1 whose display was just completed.

Figure 4:
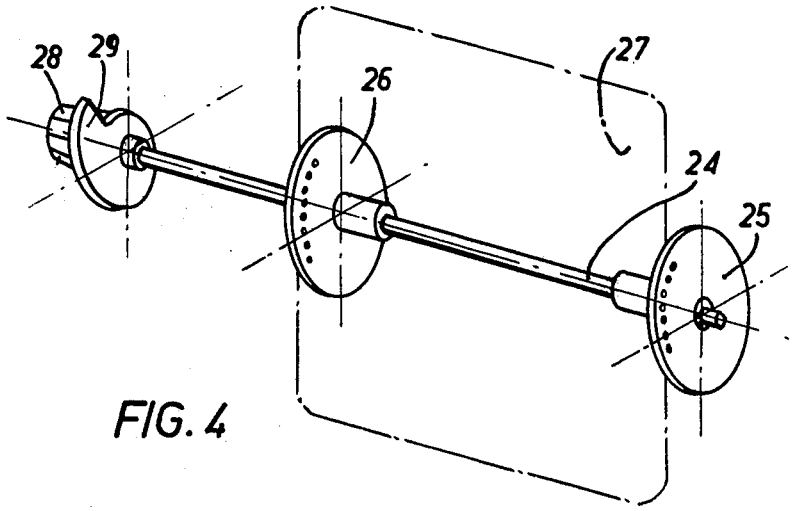
FIG. 4 is a perspective view of another portion of the drive means according to the present invention.
Figure 7:
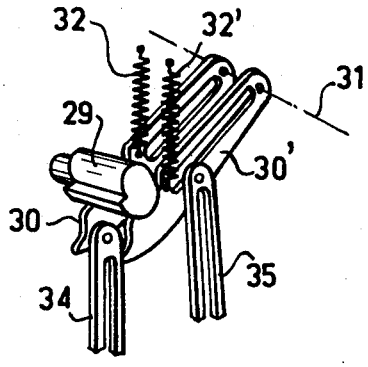
FIG. 7 is an enlarged fragmentary perspective view of another detail of the drive means according to the present invention.

Cam 21 swings lever 22 that has an upstanding head 22' and that drives the wheel 23 secured to one end of axle 24 that carries discs 25 and 26 that shift the hour plates 27 (see FIG. 4) and whose outer end is provided with a knob 28 and a cam 29. Cam 29 bears against lever 30 (compare FIGS. 2 and 7) which pivots about an axle 31 mounted on the housing of module 2, against the action of coil tension spring 32. The free end of lever 30 terminates in a head 33 which provides a manually manipulable fingerpiece.

Lever 30 may be single or double. If single, then two shafts 34 and 35 are pivotally connected to the single lever 30. But if lever 30 is double, as in FIG. 7, then it is comprised by two levers 30 and 30' which pivot about axle 31, the lever 30 driving shaft 34 and the lever 30' driving shaft 35, each lever 30 and 30' having its own spring 32 and 32', respectively.

The lower end of shaft 34 actuates a ratchet wheel 36 stepwise through dog 37, dog 37 being mounted for vertical swinging movement on the associated module wall and being interconnected with the lower end of shaft 34 by means of a coil tension spring. A knob 38 allows selective manual rotation of the drive axle (not shown) for changing the display of the names of the days of the week.

The lower end of shaft 35 actuates the ratchet wheel 39 by means of lever 40 and dog 42. Lever 40 has a lower head 41 for manual stepwise actuation. As in the case of modules 2 and 3, a knob 43 is connected externally to the drive axle (not shown) for the plates of module 4, this axle traversing the module and on whose inner end is secured the rotary cam 44. This axle changes the display of the days of the month.

Cam 44 actuates lever 45 with its dog 47 that drives wheel 48 secured to axle 49 that drives the plates displaying the names of the months. Lever 45 has a head 46 for manual actuation. Axle 49 passes through module 5 and on its outer end bears a knob 50 also for manual actuation.

The operation of the structure just described is as follows:

The motor 6 rotates shaft 7 which through the cam 8 and lever 10 stepwise rotates the wheel 19. Each step of rotation of wheel 19 can correspond to the change of one of the minute plates of module 1. Alternatively, the wheel 19 can be reset manually by pressing on the head 13, to turn the wheel 19 one step in the direction of arrow $F_1$. It is not necessary to effect any declutching or disconnection of the automatic drive, in order to make any manual adjustment that is desired. The motor continues to run as if no manual operation were being performed.

Of course, manual advance of wheel 19 can also be effected by pressing directly with the index finger on the wheel itself and frictionally rotating it in the direction of arrow $F_1$.

Considering now the module 1 to be the drive means for the module 2, the axle 20 rotates cam 21 which, as before, acts on lever 22 which provides the dog drive for the ratchet wheel 23.

It will of course be realized that the ratio between the drives for modules 1 and 2 is 60:1, so that module 2 advances one increment, that is, 1 hour, for each 60 increments of advance of module 1, that is, each 60 minutes.

It will also of course be recognized that it is not necessary to provide only one step on each of cams 8 and 21. If desired, more than one step could be provided, in which case the rotative ratio between the modules would be changed by a corresponding factor.

The left end of axle 24 carries the knob 28 which, upon rotation in the direction of arrow $F_1'$, resets the hour plates with the same ease that the minute plates can be reset as previously described, there being no interruption in the automatic drive. Thus, module 2 can be driven either automatically, through axle 20 from the right as seen in FIG. 2, or manually by knob 28 from the left as seen in FIG. 2. Alternatively, the head 22' of lever 22 can be pressed downward in the direction of arrow $F_2$ for stepwise adjustment of module 2.

Module 2 in turn drives modules 3 and 4, the cam 29 swinging the single lever 30 or the compound lever 30, 30'. The simultaneous vertical movement of the shafts 34 and 35 rotates stepwise the wheels 36 and 39 with the same frequency, because of course the days pass with the same frequency whether considered as days of the week or as days of the month. The difference, of course, is that the wheel 39 has more teeth than the wheel 36, because of course the month has more days than the week. The adjustment for months having less than 31 days can be made manually by rotation of knob 43 in the direction of arrow $F_4$ or manually by manipulation of head 41 of lever 40. Any adjustment of the days of the week is effected by rotating knob 38 in the direction of arrow $F_3$. Again, these manual adjustments are without interruption of the automatic drive.

Finally, module 4 drives module 5 in the same manner. Cam 44 swings lever 45 which acts by dog 47 on ratchet wheel 48. The rotary shaft of wheel 48 being continuous to the right of FIG. 2 is manually rotatable by rotation of knob 50 or by manipulation of head 46 in the direction of the arrow $F_5$, all without interruption of the automatic drive.

It will also be recognized that, instead of manual reset, there may be provided an automatic reset of the type shown in my U.S. Pat. No. 3,834,151. In such a system, supplemental impulses at the end of the month take account of the fact that the month may have 28, 29, 30 or 31 days.

It will therefore be recognized, that, apart from the possibility of automatic adjustment of the module 4 at the end of the month, in accordance with the teachings of my above-identified patent, there are three movements to which the mechanism of the present invention is or may be subjected:

1. The automatic drive from the motor 6 through the modules in sequence, each module other than the first being driven by the preceding module;
2. Slow stepwise adjustment by manipulation of the protruding heads of the levers so as to rotate the associated toothed wheel stepwise; and
3. Rapid manual adjustment by rotation of the appropriate knob.

From a consideration of the foregoing disclosure, therefore, it will be evident that all of the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A horological instrument that displays a plurality of time units of different lengths, comprising a plurality of modules each adapted to display a different one of said time intervals, motor means for automatically driving a first of said modules, means for driving the other said modules each from another module, each said module comprising a drive shaft individual to said module, a plurality of said drive shafts of different said modules being spaced apart and parallel to each other, a chassis supporting said modules, and a knob on each of said plurality of shafts of said other modules, said knobs being disposed outside said chassis and being rotatable by the fingers of an operator thereby manually selectively to adjust the display of each of said other modules associated with one of said plurality of shafts without interrupting said automatic drive and without changing the display of the other said modules.

2. An instrument as claimed in claim 1, each said module comprising a ratchet wheel on its associated said shaft, a dog for stepwise rotating said ratchet wheel, a lever for swinging said dog to operate said ratchet wheel, and means for manually swinging said lever, whereby each of said plurality of shafts may be rotated stepwise by manipulation of said manual swinging means, or more rapidly by rotation of the associated said knob.

3. An instrument as claimed in claim 1, said driving means comprising a cam driven by said motor and having a step thereon, said cam swinging a lever that swings a dog that rotates a ratchet wheel stepwise, said cam step having a radially outer portion that is disposed in a plane parallel to but spaced from the axis of rotation of the cam and that subtends a small angle about the axis of the cam.

4. An instrument as claimed in claim 3, two of said time intervals being minutes and hours, said cam being associated with the hour display and said cam step coming into contact with the detent on said lever at the time of the change of the display of the hour.

5. An instrument as claimed in claim 1, three of said time intervals being days of the week, days of the month, and hours, the hour change mechanism comprising an oscillable lever that simultaneously moves two shafts, one of said shafts being connected to the day of the week change mechanism and the other of said shafts being connected to the day of the month change mechanism.

* * * * *